United States Patent [19]

Nirenberg

[11] Patent Number: 4,690,077

[45] Date of Patent: Sep. 1, 1987

[54] BUTTON DELIVERY SYSTEM FOR SEWING MACHINES

[76] Inventor: Morris Nirenberg, 480 Golf Ct., North Woodmere, N.Y. 11581

[21] Appl. No.: 872,085

[22] Filed: Jun. 6, 1986

[51] Int. Cl.[4] ..... D05B 3/22

[52] U.S. Cl. ..... 112/113

[58] Field of Search ..... 112/113, 265.1, 106, 112/108

[56] References Cited

U.S. PATENT DOCUMENTS

| | | | |
|---|---|---|---|
| 3,337,089 | 7/1965 | Bronfman | 221/160 |
| 3,382,824 | 5/1968 | Bronfman | 112/113 |
| 3,633,524 | 1/1972 | Hoffsommer | 112/113 |
| 3,807,328 | 4/1974 | Lombardo | 112/113 |
| 3,889,612 | 6/1975 | Hughes et al. | 112/113 |
| 4,445,448 | 5/1984 | Fletcher | 112/113 |

*Primary Examiner*—Ronald Feldbaum

*Attorney, Agent, or Firm*—Amster, Rothstein & Ebenstein

[57] ABSTRACT

The invention relates to a button delivery system and features improvements in three major areas, the button feeding mechanism for feeding buttons to the sewing machine, a button supply system for supplying buttons to the button feeding mechanism, and a support for positioning the button feeding mechanism with respect to the sewing machine for the smooth transfer of buttons into the sewing machine.

14 Claims, 15 Drawing Figures

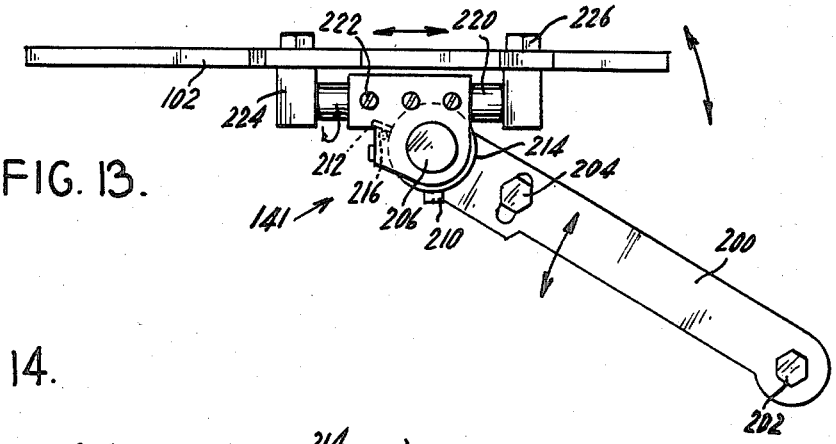
FIG. 13.
FIG. 14.
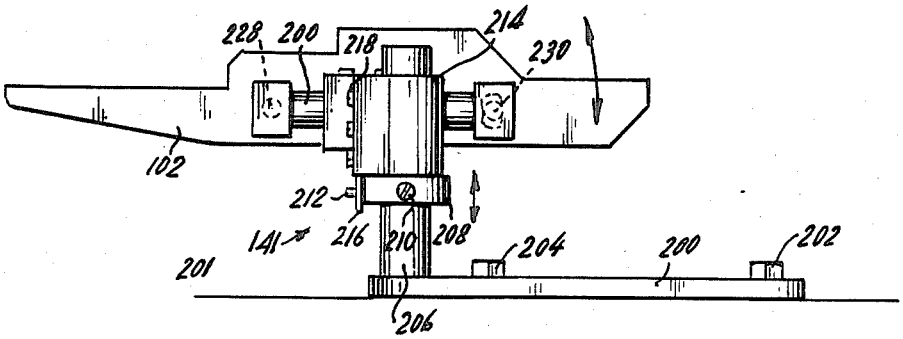
FIG. 15.
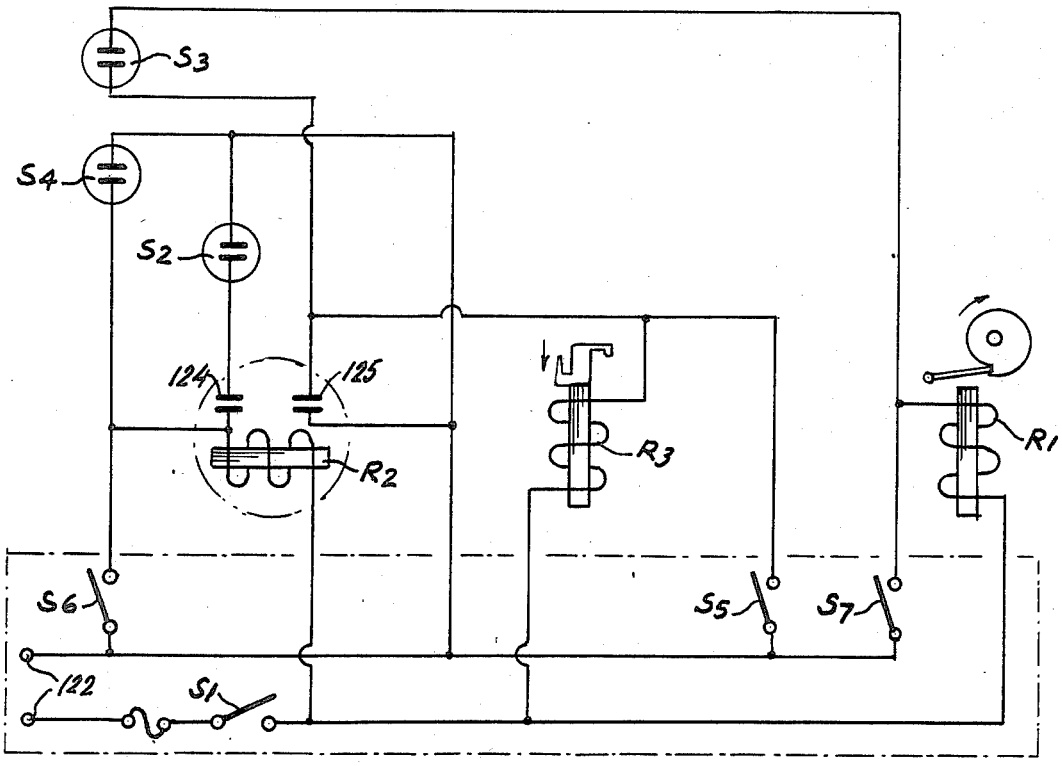

BUTTON DELIVERY SYSTEM FOR SEWING MACHINES

BACKGROUND OF THE INVENTION

The invention relates to a button delivery system for sewing machines and particularly to improvements in a button delivery system comprising a button supply system, a button feeding mechanism, and a support system for the button feeding mechanism.

The many articles such as clothes which include buttons have resulted in the need for manufacturers to have economical operations for sewing the buttons on the articles rapidly and repetitively. A system for sewing buttons on articles preferably has the button positioned automatically on the article and with respect to the sewing machine so that the sewing needle passes through the holes in the button for sewing the buttons onto the article. Misalignment of the sewing needle with respect to the holes in the button can result in the buttons being damaged, the needle being broken, and/or the button not being sewed on the article. In the prior art, the equipment for automating the sewing of buttons on articles has been broadly separated into a button supply system and a button feeding mechanism. Generally, the button supply system such as disclosed in U.S. Pat. No. 3,337,089 to Bronfman includes a hopper for holding a plurality of buttons to be used, a system for discharging buttons from the hopper in a predetermined orientation, such as face up, and a chute through which the discharged buttons slide to a button feeding mechanism for a sewing machine. The chute must have a cross sectional area which allows the buttons to move down freely but is not large enough to allow several buttons to collide with each other and cause a jam within the chute. The button supply system such as disclosed by Bronfman requires the availability of flexible chutes having cross sections with different sizes in order to have the proper size chute for the buttons being used. In addition, the transition from the use of one size button to the use of another size button requires a mechanic to change the chute and also requires the associated sewing machine be taken out of service while the mechanical changes are being carried out.

A button feeding mechanism such as disclosed in U.S. Pat. No. 3,382,824 to Bronfman receives the button from the button supplying system, orients the button so that the button holes are aligned in accordance with the predetermined sewing pattern of the sewing machine, and then feeds the oriented button into the clamp of the sewing machine so that the operator of the sewing machine can initiate a button sewing sequence of the sewing machine which includes moving the clamp with the button to the article, sewing of the button onto the article, and raising the clamp to its original position to receive another button for subsequent sewing operations. The button feeding mechanism disclosed in this patent has a complex mechanical linkage for feeding a button into the clamp of the sewing machine and another complex mechanical linkage to commence a button feeding sequence for a certain movement of the sewing machine. A relatively large drive motor is needed in order to provide a sufficient mechanical drive for the mechanical system. Although not mentioned in the patent, the button feeding mechanism must be positioned with respect to the clamp of the sewing machine so that the height, various angles of orientation, and spacing of the button feeding mechanism is within predetermined tolerances to allow the smooth interaction between the button feeding mechanism and the sewing machine. In the prior art, it has required a skilled mechanic to both install a button feeding mechanism and reinstall the button feeding mechanism after it has been removed for service. As a result, both the initial installation and reinstallation of the button feeding mechanism can be costly and time consuming.

OBJECTS AND SUMMARY OF THE INVENTION

It is an object of the present invention to provide an improved button delivery system for a sewing machine.

It is another object of the present invention to provide an improved button feeding mechanism for a sewing machine.

It is a further object of the invention is to provide an improved button supply system for a button feeding mechanism.

An additional object of the present invention is a button supply system which can supply buttons to a flexible chute in a wide range of sizes without the necessity of changing the chute to accomodate buttons of different sizes.

Still a further object of the invention is a support system for a button feeding mechanism in order to simplfy the initial installation of a button feeding mechanism with respect to the clamp of a sewing machine and to allow the simple removal and reinstallation of the button feeding mechanism by a relatively unskilled person.

In one embodiment, the invention relates to a button feeding mechanism for feeding buttons to a clamp on a raised arch of a sewing machine wherein the button feeding mechanism comprises a frame, driving means mounted on the frame, a first rod mounted on the frame for reciprocal movement and having an initial position, coupling means for coupling the driving means to the first rod selectively to move the first rod from its initial position through a cycle of movement, orienting means mounted on the frame for orienting a button with respect to the sewing pattern of the sewing machine and mechanically coupled to the first rod, a second rod mechanically coupled to the first rod and mounted on the frame for reciprocal motion, and moving means coupled to the record rod for moving a button through the orienting means to the clamp of the sewing machine, and the improvement comprises the coupling means comprising a clutch controlled by an electrical circuit energized by the simultaneous condition of the arch of the sewing machine being in its raised position subsequent to being in its lowered position and the first rod being in its initial position.

Another embodiment of the invention relates to a button supplying system for supplying buttons to a button feeding mechanism for a sewing machine, comprising a hopper for holding a plurality of buttons, a first chute connected to the hopper for receiving buttons discharged from the hopper, means to discharge buttons having a predetermined orientation from the hopper to the first chute, a second chute connected to the first chute for directing buttons from said first chute to the button feeding mechanism means for controlling the transfer of a button from the first chute to the second chute in responsive to an electrical signal, and means connected to the sewing machine for producing the electrical signal for the controlling means when the sewing machine is in a predetermined operating position.

Yet another embodiment of the invention relates to a support for positioning a button feeding mechanism near a sewing machine for the smooth feeding of buttons into the sewing machines wherein, the support comprises mounting means comprising a base and means for connecting the base to a surface so that a portion of the base can be moved parallel to the surface or so that the base is fixed with respect to the surface; a first component comprising a cylindrical portion connected to and extending vertically from the portion of the base which can be moveable; a cylindrical collar engaging the cylindrical portion and comprising means to fix its position axially and rotationally with respect to the cylindrical portion and a first extended portion for use in fixing the rotational position of the button feeding mechanism; a second component having a cylindrical opening engaging the cylindrical portion, the second component being supported by the cylindrical collar and comprising means to fix its angular position with respect to the cylindrical portion and a second extension which engages the first extension to define the angular position of the second component by the angular position of the cylindrical collar; a third component connected to the second component and comprising a cylinder mounted for both axial and rotational movements with respect to the third component and having its axis generally parallel to the surface, means to fixed the position of the cylinder both axially and rotationally with respect to the third component; and means for connecting the cylinder to the button feeding mechanism so that the button feeding mechanism can be rotated around an axis parallel to the surface or said button feeding mechanism can be fixed with respect to the surface.

In still another embodiment, the invention relates to a button delivery system for a sewing machine comprising the button supplying system, button feeding mechanism, and support for the button feeding mechanism disclosed herein.

The above and other objects, advantages, features and aspects of the present invention will be more readily apparent from the following description of the preferred embodiment thereof taken with the accompanying drawings and appended claims.

BRIEF DESCRIPTION OF THE DRAWINGS

The present invention is illustrated by way of example and without limitation in the accompanying figures in which like references indicate like parts, and in which:

FIG. 13 is a top plan view on a reduced scale of a support system according to the invention connected to the base plate of the button feeding mechanism shown in FIG. 2;

FIG. 14 is a rear elevational view of the support system as shown in FIG. 13; and FIG. 15 is an electrical schematic for the operating circuit of the button delivery system shown in FIG. 1.

DISCUSSION OF THE INVENTION

Figure 1:
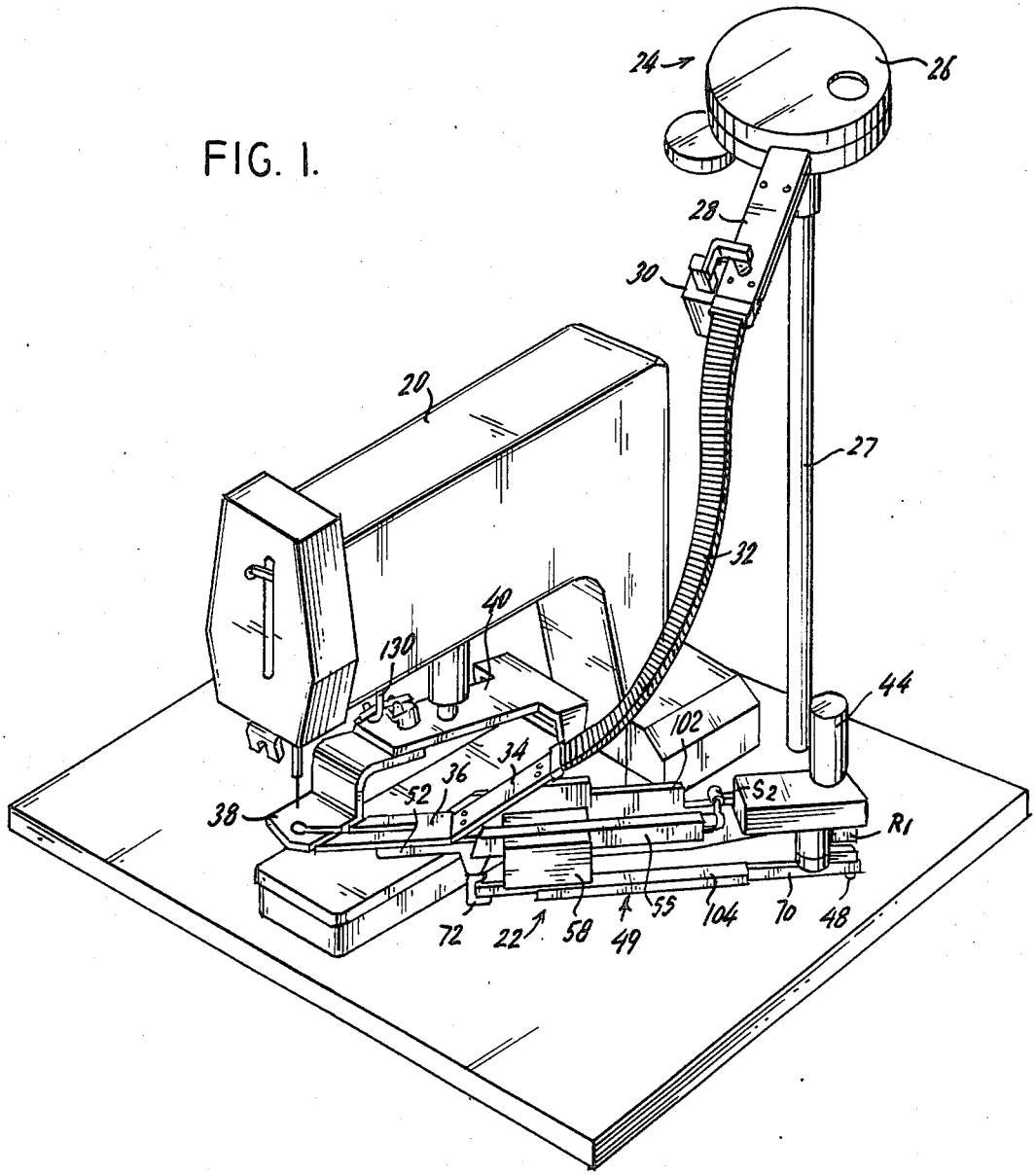
FIG. 1 is a perspective schematic sketch showing a prior art sewing machine, and an embodiment of a button delivery system according to the invention.

Referring to FIG. 1, FIG. 1 is perspective schematic view of a button sewing system which includes a sewing machine 20, a button feeding mechanism 22, and a button supply system 24. The support system for the button feeding mechanism 22 can not be seen in FIG. 1. Generally, a hopper 26 is supported by a stand 27 and buttons in the hopper 26 are oriented according to a predetermined orientation such as face up and are then discharged into rigid chute 28. The aforementioned U.S. Pat. No. 3,337,089 disclosed a suitable hopper. According to the instant invention, control system 30 allows buttons to pass from the rigid chute 28 to flexible chute 32 under certain circumstances as will be described hereinafter, so that buttons will slide down the flexible chute 32 to a rigid chute 37 which forms part of the button feeding mechanism 22. The use of a flexible chute 32 allows the hopper 26 to be conveniently located with respect to the button feeding mechanism 22 and is generally known in the art but prior art requirements have limited the chute 32 to sizes closely associated with the size of the buttons being used because the prior art operation sends a stream of buttons into a flexible chute and the buttons can become jammed in this chute. It is known in the art to construct flexible chute 32 in the form of a spring wound from a circular wire and having a rectangular cross section and such chutes are available commercially.

Figure 10:
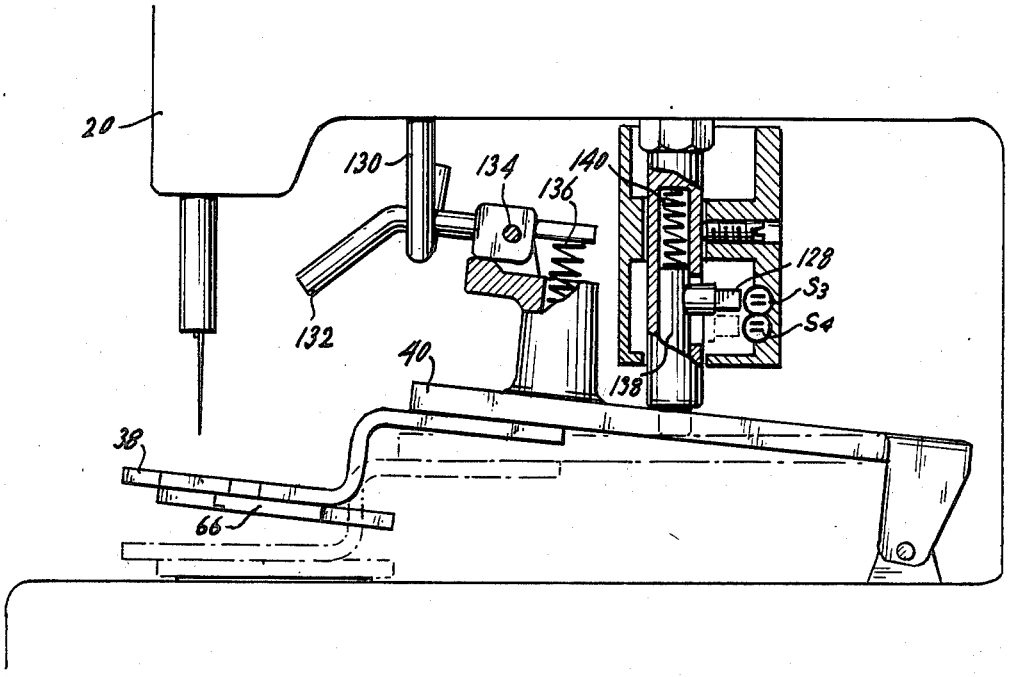
FIG. 10 is a front elevational view on an enlarged scale of a portion of FIG. 1, with portions removed to show internal components.

The button feeding mechanism 22 is activated when the sewing machine 20 is energized to a position for sewing a button. In a typical commercial operation, the operator of the sewing machine 20 moves a knee switch (not shown) or the like in accordance with the art and clamp 38 is carried down with arch 40 as shown in FIG. 10. The clamp 38 has a properly oriented button 66 previously positioned therein from the button feeding mechanism 22. The movement of the arch 40 downward causes an electrical circuit to close as will be disclosed in detail later on so that control system 30 releases a button down into the flexible chute 32 to the button feeding mechanism 22, thereby maintaining the total number of buttons in the button feeding mechanism 22 substantially constant while avoiding any jamming of buttons in the flexible chute 32 because of the separate release of buttons at spaced time intervals. After a button has been sewn on an article (not shown), the arch 40 moves back to the position shown in FIGS. 1 and 10, thereby aligning the clamp 38 with button feed path 36 so that another button can be delivered into the clamp 38 for a subsequent button sewing operation. It can be readily appreciated from FIG. 1 that the mechanical alignment of the button feed path 36 with respect to the clamp 38 is important for a smooth transition of a button there between. The plane of the button feed path 36 must be critically aligned to be coplanar with the plane of the portion of the clamp 38 which receives a button and the spacing between the button feed path 36 and the clamp 38 must be appropriate for the movement of the button by the button feeding mechanism 22.

Figure 2:
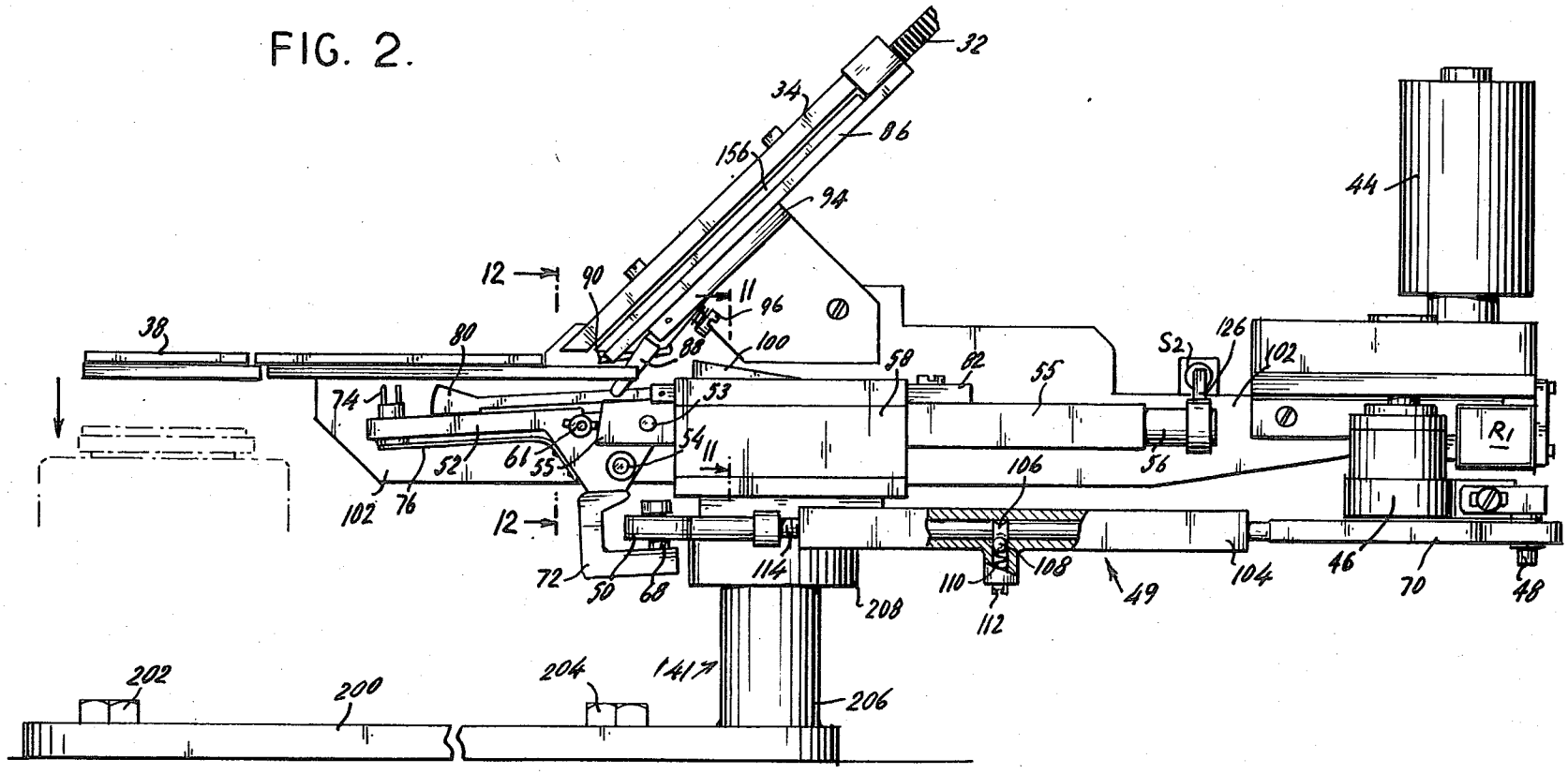
FIG. 2 is a side elevational view on an enlarged scale of the button feeding mechanism shown in FIG. 1, with portions removed to show internal components.
Figure 3:
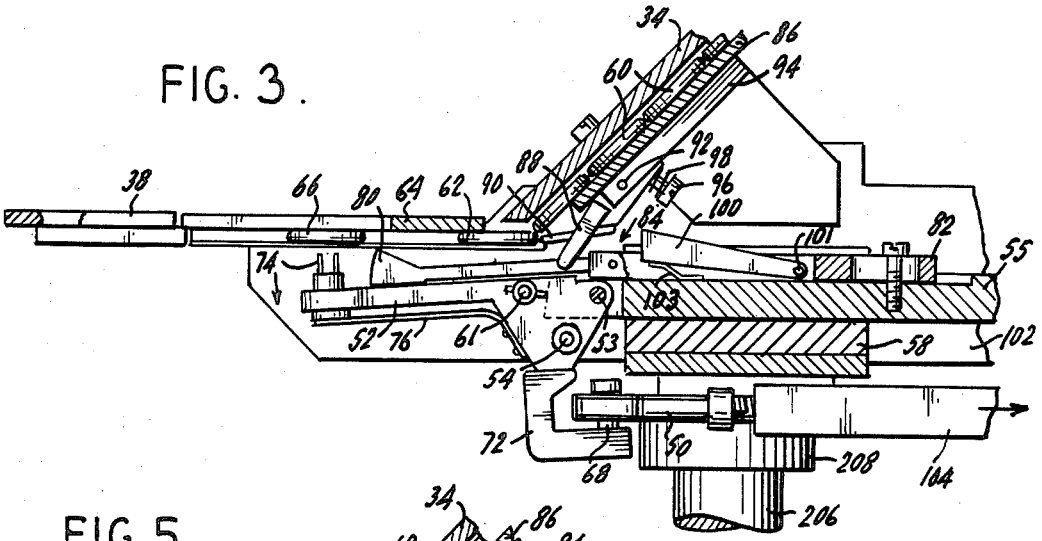
FIG. 3 is a side elevational view of a portion of the button feeding mechanism of FIG. 2 with portions removed to show internal components.
Figure 5:
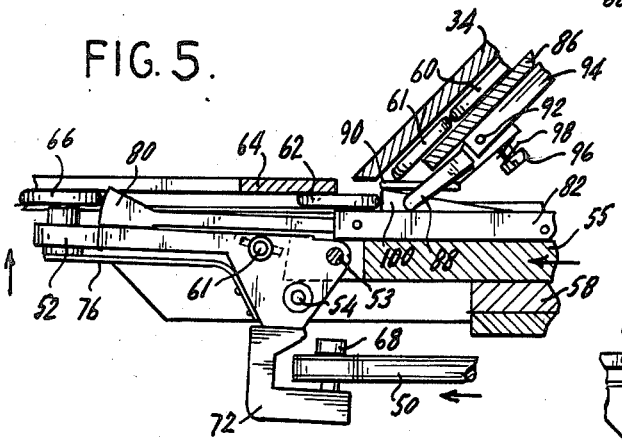
FIG. 5 is a side elevational view of a portion of the button feeding mechanism shown in FIG. 3 with the button feeding mechanism in yet another operating position.
Figure 4:
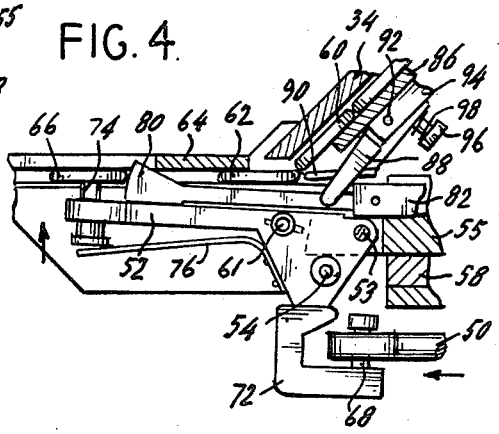
FIG. 4 is a side elevational view of a portion of the button feeding mechanism shown in FIG. 3 with the button feeding mechanism in a different operating positon.
Figure 6:
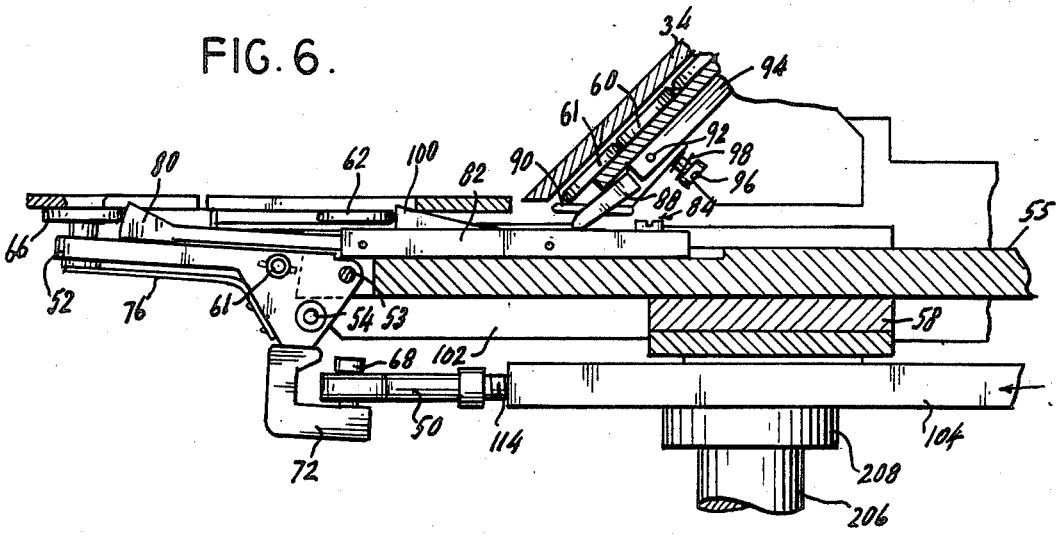
FIG. 6 is a side elevational view of the button feeding mechanism of FIG. 3 with the button feeding mechanism in still another operating position.

Referring to FIGS. 2 to 6, a more detailed description of the button feeding mechanism 22 will now be given. FIG. 2 shows the button feeding mechanism 22 supported by support 141 which is shown in more detail in FIGS. 13 and 14 and will be described later on with reference to these figures. As shown in FIG. 2, the feeding mechanism 22 is in its initial position for feeding a button to the clamp 38. Driving means including a drive motor 44 operating continuously and a gear train is coupled to clutch 46 when solenoid $R_1$ is energized so that a single revolution of the drive motor 44 causes the button feeding mechanism 22 to deliver a button to the clamp 38 and to carry out its other operations. Generally, the drive motor 44 has a speed of from 8,000 to 10,000 RPM and the gear train provides a speed of about 200 RPM. The solenoid $R_1$ can be be energized either by a separate electrical switch which is closed by the operator or by an electrical circuit which includes a switch closed by the arch 40 moving to its raised position. The electrical circuits will be discussed in detail in connection with FIG. 15 later on. The clutch 46 is rotated through one cycle of the drive motor 44 so that pin 48 rotates through a single revolution in a plane perpendicular to the plane of FIG. 2, thereby causing mechanical coupling 49 between the pin 48 and rod end 50 to reciprocate back and forth. As a result, the rod end 50 moves from the position shown in FIG. 2 to the position on the left as shown in FIG. 6 and then back to its initial position as shown in FIG. 2. Plate 52 is rotatably mounted at pivot 53. The movement of shaft 55 is arranged to encounter some physical resistance so that the movement of the rod end 50 to the left initially causes the rotation of the plate 52 upward as shown in FIG. 4 until the plate 52 can not move upward any more due to stop 54 contacting shaft 55 and then plate 52 moves to the left as shown in FIG. 5 while the shaft 55 moves through journaled box 58. After the drive motor 44 moves the pin 48 through half a revolution, plate 52 has moved its maximum distance to the left as shown in FIG. 6. Thereafter, the continued rotation of the pin 48 will eventually cause the plate 52 to return to its initial position as shown in FIG. 2. After the plate 52 has reached its maximum position on the left, the movement of the rod end 50 to the right causes the plate 52 to rotate down due to the shaft 55 being inhibited from moving. The plate 52 rotates until stop 60 contacts the shaft 55. Thereafter, the plate 52 is pulled to the right as the shaft 55 slides through the box 58.

Figure 12:
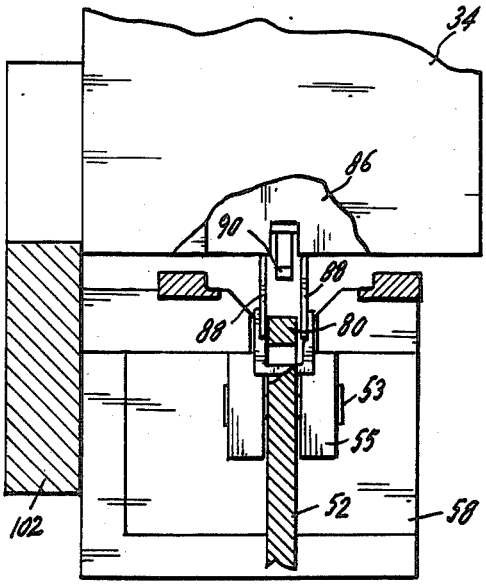
FIG. 12 is a sectional view on an enlarged scale of FIG. 2 along the line 12—12.

Additional details in the FIGS. 3 to 6 will now be given. In FIG. 3, buttons 60, 61 are shown in rigid chute 34 and restrained from moving down chute 34 by button 62 which is inhibited from movement by slight pressure from a side detent (not shown). Button 66 is in a position for being fed to the sewing machine 20 during the next operating cycle of the button feeding mechanism 22. The operation of the button feed path 36 is known in the art and such a system is disclosed the forementioned U.S. Pat. No. 3,382,824. As the button 66 is pushed through the button feed path 36 as shown in FIG. 4, pressure on the button 66 on its upper surface at one side of the button feed path 36 results in the button 66 rotating around its axis. As the button 66 rotates, two pins 74 rest against the lower surface of the button 66 as shown in FIG. 4 until the holes in button 66 align with the pins 74 and the pins 74 enter the holes, as shown in FIG. 5. When the pins 74 enter the button holes, the button 66 stops rotating and is fed thus oriented to the clamp 38 as shown in FIG. 6. As shown as in FIG. 3, the button feeding mechanism 22 has just completed an operating cycle of feeding a button to the clamp 38. The new operating cycle is started by the operation of the sewing machine 20 when it is energized to sew on a button. FIG. 4 shows the initial movement of rod end 50 for a cycle of of the button feeding mechanism 22. Rod end 50 has a bearing mount for pin 68 and is journaled for rotation. It can be readily appreciated from FIG. 2 that the rotation of the pin 48 shown in FIG. 2 will swing rod 70 through an angle in a plane perpendicular to the plane of FIG. 2 and with a vertex at pin 68. Movement of the rod end 50 to the left communicates a force to the plate 52 through the mechanical coupling 72. FIG. 4 shows the plate 52 has rotated up around pivot 53 so that the pins 74 contact button 66 and are urged upward by leaf spring 76 which is mounted on the plate 52 with screws 78. A first button pusher 80 contacts the button 66 as shown in FIG. 4 while plate 82 is about to rotate control 84 up to prevent the buttons 60, 61 from moving down the chute 34 throughout the cycle of the button feeding mechanism 22. The control 84 as shown in FIG. 12 is mounted on plate 86 and includes two side fingers 88 rigidly connected to a center finger 90 with the side fingers 88 rotatably connected at journaled joint 92 to plate 94 with bolt 96 which is loaded with spring 98 to bias the center finger 90 away from the button 61. As plate 82 moves to the left, it raises side fingers 88 as shown in FIGS. 5 and 6 and correspondingly raises the center finger 90 so that the button 61 is blocked as shown in FIGS. 5 and 6. The buttons 60, 61 remain blocked as long as the side fingers 88 rest on the plate 82 and this occurs until the initial position as shown in FIG. 3 is obtained again.

The first button pusher 80 pushes the button 66 through the button feed path 36 and this causes the button 66 to rotate about its axis until the holes in the button 66 become aligned with the pins 74 so that the pins 74 penetrate the button holes and prevent further rotation of the button 66 as shown in FIG. 5. FIG. 5 shows the pins 74 have engaged the button holes of the button 66 and moved upward due to the leaf spring 76. FIG. 3 shows a second button pusher 100 rotatably mounted at pivot 101 and resting on spring metal 103. The second button pusher 100 is depressed during its movement as it passes under the center finger 90, contacts the button 62 as shown in FIG. 5 and it moves this button 62 to the initial position of the button 66 as shown in FIG. 3. Meanwhile, the button 66 is moved into the clamp 38 by the first button pusher 80 as shown in FIG. 6. Thereafter, the rod end 50 moves to the right so that the initial arrangement as shown in FIG. 3 is obtained.

FIG. 2 shows a preferred arrangement for the mechanical coupling 49 which provides for unusual resistance to the movement of rod end 50 such as jamming or the like. Such an arrangement is a safety against damages. Rod 70 extends into block 104 and has a circular grove 106 engaged by ball 108 which is biased due to spring 110. The tension of the spring 110 can be adjusted with screw 112. The bar 70 does not extend entirely through block 104 and is retained mechanically to the block 104 by the arrangement of the ball 108 in the circular groove 106. Rod 114 is connected to the block 104. If rod end 50 is inihibited from movement during a cycle, the rod 70 will become disengaged from the ball 108 and move within the bar 104 thereby avoiding damage wherever jamming occurs. Other safety devices can be used coupling the rod 70 to the block 104 to provide similar protection against jamming.

Figure 11:
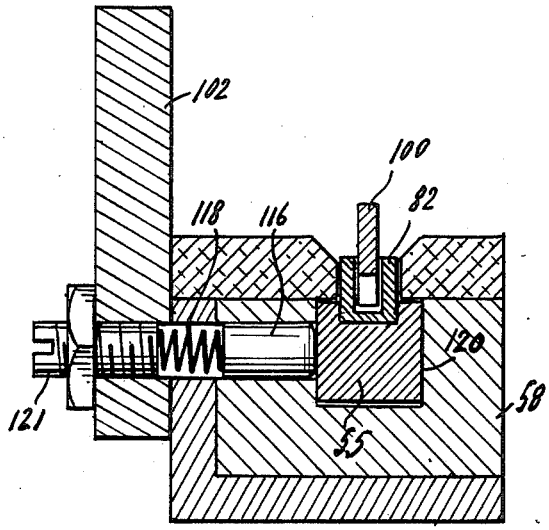
FIG. 11 is a sectional view on an enlarged scale of FIG. 2 along the line 11—11.

During the initial movement of the bar 70 to the left, it is essential that the shaft 55 resists movement to the left to an extent that the force exerted by the rod end 50 on the plate 52 will rotate the plate 52 clockwise into the position shown in FIG. 4. In addition, after the delivery of the button 66 to the clamp 38 as shown in FIG. 6, the shaft 55 must be inihibited sufficiently so that the movement of the rod end 50 to the right will rotate the plate 52 counterclockwise before the shaft 55 starts to move to the right. FIG. 11 shows a preferred embodiment fot inhibiting the movement of the shaft 55 in either direction of movement to produce the desired rotation of the plate 52. A suitable metal cylinder 116 in a circular hole in the block 58 is urged against the shaft 55 by a spring 118 which has it tension adjusted by bolt 121. The force on the shaft 55 between the cylinder 116 and the bearing surface 120 produces a frictional force which inihibits the movement of the shaft 55 sufficiently to accomplish the desired movement of the plate 52 during the cycle of the button feeding mechanism 22. The bearing surface 120 can be nylon or the like.

Figure 7:
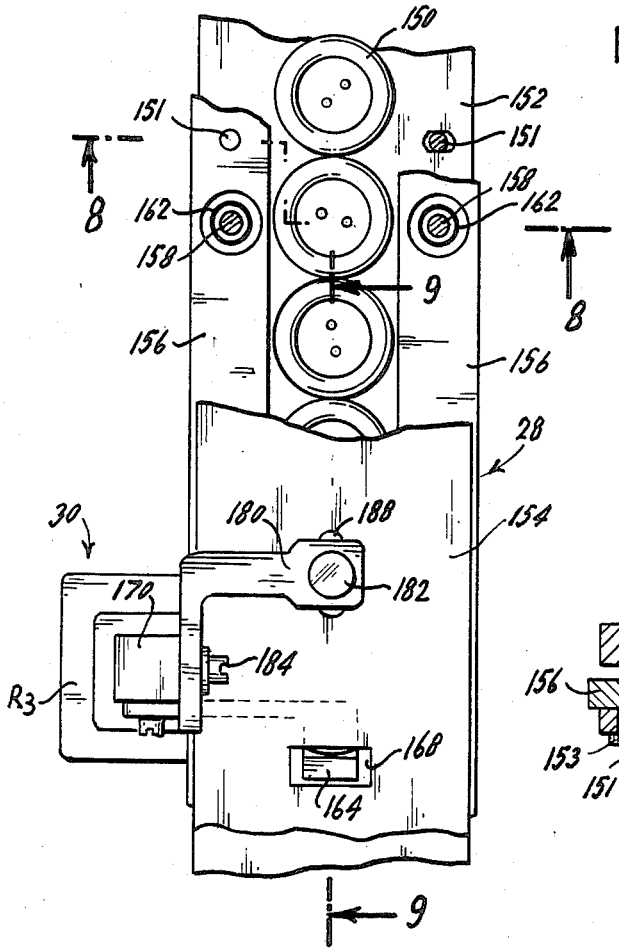
FIG. 7 is a plan view on an enlarged scale of a portion of the button supply system shown in FIG. 1, with portions removed to show internal components.
Figure 8:
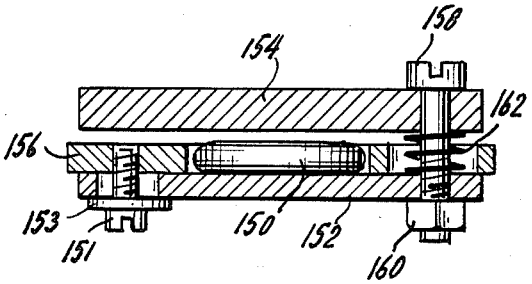
FIG. 8 is a sectional of FIG. 7 along the line 8—8.
Figure 9:
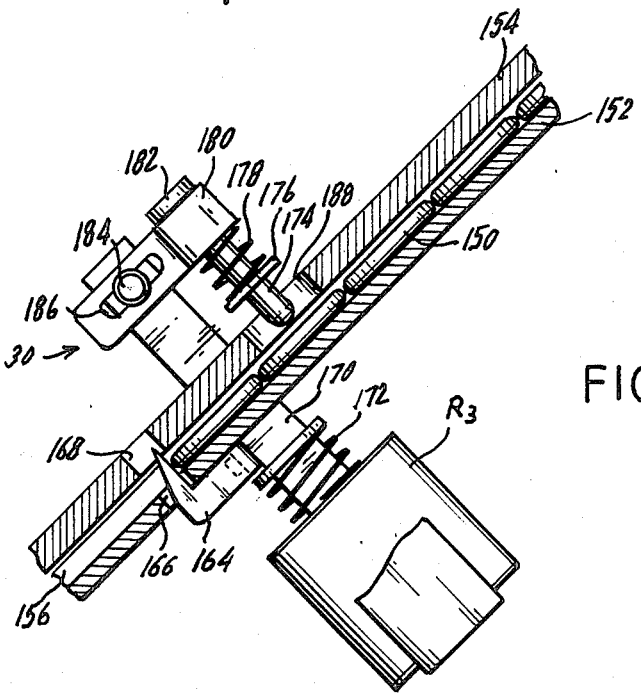
FIG. 9 is a sectional of FIG. 7 along the line 9—9.

Referring to FIGS. 7 to 9, a description of the control system 30 will be given. Buttons 150 from the hopper 24 accumulate in the rigid chute 28. The rigid chute 28 has a lower metal surface 152 and an upper surface 154 spaced from each other by strips 156. The upper and lower surfaces 152, 154 are held together by bolts 158 and nuts 160 which are spring loaded with spring 162. Screw 151 and washer 153 connect lower metal surface 152 to strip 156. FIG. 9 shows pawl 164 extending up through openings 166, 168 to prevent the buttons 150 from moving down the rigid chute 128. When the solenoid $R_3$ is energized, shaft 170 is pulled into the solenoid $R_3$ against spring 172 thereby moving the pawl 164 out of the way of the buttons 150. The shaft 170 moves cylinder 174 against the button 150 under it before the pawl 164 moves out of the path of the buttons 150. The cylinder 174 has a circular flauge 176 and a spring 178 biases the cylinder 174 away from the bracket 180. The cylinder 174 is mounted in a hole in the bracket 180 and has a head 182 which prevents it from falling out the bracket 180. When the solenoid $R_3$ is no longer energized, the pawl 164 returns to the position shown in FIG. 9 to prevent any additional buttons 150 from moving down the rigid chute 28 and then the cylinder 174 moves away from the buttons 150. The bracket 180 is attached to the shaft 170 with a bolt 184 through a slotted hole 186 so that the cylinder 174 can be positioned within the aperture 188 depending upon the size of the buttons 150.

FIG. 10 shows a preferred arrangement for the control system for the movement of the arch 40. Generally, the operator of the sewing machine 20 closes a switch (not shown) which allows hook 130 to move down. As a result, the arch 40 moves down so that the button 66 is positioned on an article for sewing. After the button 66 has been sewed onto the article, the hook 130 is pulled up and thereby raises hook 132 which is connected to the arch 40. In the prior art, the hook 130 is rigidly connected to the arch 40 and the repeated sudden movements upward creates severe stress on the mechanical arrangement. For the embodiment shown, the hook 132 is rotatably mounted at pivot 134 and spring biased with spring 136. The stress due to the sudden upward movement of the hook 132 is minimized by the spring 136 absorbing the mechanical energy. Moreover, the position of the clamp 38 is not disturbed by this arrangement. FIG. 10 also shows a cylinder 138 biased by a spring 140 so that the cylinder 138 will follow the movement of the arch 40. A magnet 128 mounted in the cylinder 138, moves between switches $S_3$ and $S_4$ to change the electrical circuit as will be described in connection with FIG. 15.

Referring now to FIGS. 13, and 14. The support 141 will be described. Base 200 is attached to a surface 201 so that the button feeding mechanism 22 will be favorably located with respect to the clamp 38. For convenience, FIGS. 13 and 14 show only the support bracket 102 of the button feeding mechanism 22. The base 200 is attached to the surface 201 using bolts 202, 204. The hole in the base 200 for bolt 202 substantially matches the diameter of the bolt 202 whereas the hole in the base 200 for bolt 204 is elongated so that the base 200 can rotate about bolt 202 when the bolts 202, 204 are not tightened. This rotation of the base 200 allows for an adjustment of the position of the button feeding mechanism 22 with respect to the clamp 38. A first component including a cylindrical portion 206 is connected to the base 200 in the vicinity of the portion of the base 200 which is movable when the bolts 202, 204 are not tightened. The cylindrical portion 206 extends substantially vertically and preferably has a circular cross section. A cylindrical collar 208 engages the cylindrical portion 206 and can be moved both axially and rotationally with respect to the cylindrical portion 206. A bolt 210 can be tightened to fix the position of the cylindrical collar on the cylindrical portion 206. The cylindrical collar 208 has an extension 212 which interacts with another portion of the support 141 and will be described later on. A second component 214 has a cylindrical opening and engages the cylindrical portion 206 while resting on the cylindrical collar 208. The second component 214 has an extension 216 which extends downward as shown in FIG. 13. When installed, the second component 214 is rotated so that the extension 216 abuts the extension 212 so that the rotational position of the component 214 is determined by the rotational position of the cylindrical collar 208. The second component 214 is fixed in position on the cylindrical portion 206 by set screws 218. A third component 220 is in the shape of a cylinder and engages the second component 214 so that the axis of the cylinder 220 is approximately parallel to the surface 201. The cylinder 220 can be moved axially and rotationally within the second component 214 and can be fixed in place by the use of set screws 222. The cylinder 220 is connected to the base plate 102 with blocks 224 and bolts 226. The base plate hole 228 engages the bolt 226 with little freedom of movement of the base plate 102 while hole 230 is an elongated slot so that rotation of the base plate 102 around the hole 228 in a plane perpendicular to the ground 201 is possible when the bolts 226 are not tightened. This allows yet another adjustment. After the button feeding mechanism 22 has been positioned with respect to clamp 38 using the support 141, all of the various bolts and screws are tightened. In this arrangement, the extension 216 is contacting the extension 212. Removal of the button feeding mechanism 22 is carried out by loosening the set screws 218. No other screws or bolts need be loosened. Returning the button feeding mechanism to service only requires the second component 214 be engaged with the cylindrical portion 206 until a second component 214 rests on the cylindrical collar 208 and then second component 214 is rotated so that once again the extension 216 abuts the extension 212. Tightening the set screws 218 results in the button feeding mechanism 22 being returned to precisely the same position it had before its removal. No additional measurments or changes in the orientation of the support 141 are required.

The electrical circuit shown in FIG. 15 enables the safe and reliable operation of the button feeding mechanism 22. A voltaqe is applied to terminals 122 for the operation of the button feeding mechanism and is typically a relatively low voltage, about 24 volts DC. The drive motor 44 can be appropriately selected for operation at a low voltage. Switch $S_1$ is the main power switch for the button feeding mechanism 22. Switches $S_{\equiv}$, $S_6$ and $S_7$ are normally open and are the type of switches such as microswitches which can be momentarily closed but return to their normally open state when released. Switch $S_6$ is used to latch double pole single throw Relay $R_2$ to start the button feeding mechanism 22 by closing the internal switches 124, 125. Actuator $R_1$ is used to initiate a cycle of the button feeding mechanism 22 and solenoid $R_3$ controls the escapement of the control system 30 on the chute 28 as shown in FIG. 1: Switches $S_2$, $S_3$ and $S_4$ are normally open and preferably magnetic reed type switches. Magnetic reed type switches are well known in the prior art and typically have two states, an "on" state and "off" state, which is changed by being near or away from a magnet. Magnetic reed type switches enable two mechanical parts which are moving relative to each other to change the state of a circuit without physically contacting each other. A magnet is mounted on one part and magnetic reed switch on the other part so that the magnet is near the magnetic reed switch at the time when a change in the circuit is desired. The location of the switch $S_2$ can be seen in FIG. 2 and is near the position of the right hand end shaft 55 when it is in its initial position. A magnet 126 is mounted on the shaft 55 and the switch $S_2$ 2 mounted on the plate 102. As a result, the switch $S_2$ is normally open when the shaft 55 is away from its initial position. The switches $S_3$ and $S_4$ are mounted on the sewing machine 20 as shown in FIG. 10 so that the magnet 128 is near the switch $S_3$ when the clamp 38 is in its raised position to receive a button and near the switch $S_4$ when the clamp 38 is in its lower position so that a button can be sewn on to an article. The operation of the circuit shown in FIG. 15 is as follows. The button feeding mechanism 22 is in its initial position as shown in FIG. 2 so that switch $S_2$ is closed and the arch 40 is raised as shown in FIG. 10 so that switch $S_3$ is closed. The relay $R_2$ is initially open. The switch $S_6$ is momentarily closed so that the relay $R_2$ causes the switches 124, 125 to close so that the circuit path through the switch $S_2$ to the switch $S_3$ energizes the actuator $R_1$ to couple the clutch 46 to the driving motor 44 momentarily to allow an operating cycle of the button feeding mechanism 22. Once the driving motor 44 starts the movement of the rod 70, the subsequent movement of the shaft 55 moves the magnet 126 away from the switch $S_2$ thereby opening the circuit to the actuator $R_1$ so that only one cycle of the button feeding mechanism 22 can take place for a single energizing of the actuator $R_1$. This allows a single revolution of the motor 24 to be communicated into the cycle of the button feeding mechanism 22. When the arch 40 moves down, the magnet 128 closes the switch $S_4$ as shown in FIG. 10, and this completes a circuit through the relay $R_2$. The return of the shaft 55 to its initial position closes the switch $S_2$ to complete a circuit through the switch 125 to the actuator $R_1$ when the arch 40 is raised and the switch $S_3$ is closed. The required sequence of the switch $S_4$ being closed before the switches $S_2$, $S_3$ can operate the actuator $R_1$ requires the arch 40 to be moved down and then up. Thus, leaving the arch 4O in its raised position will not result in the button feeding mechanism 22 operating to deliver buttons. When the switch $S_4$ is closed, the relay $R_2$ closes to energize solenoid $R_3$ to release a button to the button feeding mechanism 22.

I claim:

1. In a button feeding mechanism for feeding buttons to a clamp on a raised arch of a sewing machine wherein the button feeding mechanism comprises a frame, driving means mounted on said frame, a first rod mounted on said frame for reciprocal movement and having an initial position, coupling means for coupling said driving means to said first rod selectively to move said first rod from its initial position through a cycle of movement, orienting means mounted on said frame for orienting a button and coupled to said first rod, a second rod coupled to said first rod and mounted on said frame for reciprocal motion, and moving means coupled to said second rod for moving a button through the orienting means to the clamp of said sewing machine, the improvement comprises said coupling means comprising a clutch controlled by an electrical circuit energized by the simultaneous condition of the arch of said sewing machine being in its raised position subsequent to being in its lowered position and said first rod being in its initial position.

2. The button feeding mechanism of claim 1, wherein said electrical circuit includes first, second and third switches, the position of the arch of said sewing machine determines whether said first and second switches are respectively closed or open and the position of said first rod determines whether said third switch is open or closed.

3. The button feeding mechanism of claim 2, wherein said first, second and third switches are magnetically activated reed switches.

4. The button feeding mechanism of claim 1, wherein said electrical circuit includes a control switch for energizing said clutch independently of the position of the arch of said sewing machine.

5. The button feeding mechanism of claim 1, wherein said first rod is coupled to said second rod through a mechanical system which includes means for decoupling said first rod from said second rod if jamming or the like occurs to inhibit the movement of said first rod.

6. The button feeding mechanism of claim 4, wherein said decoupling means comprises a block engaging said first rod, a circular groove around the circumference of said first rod, a ball positioned in said groove and inhibiting the movement of said first rod with respect to said block, and means to maintain the position of said ball as long as the force applied to said first rod with respect to said block is less than a predetermined level of force.

7. A button supplying system for supplying buttons to a button feeding mechanism for a sewing machine, comprising hopper for holding a plurality of buttons;

a first chute connected to said hopper for receiving buttons discharged from said hopper;

means to discharge buttons having a predetermined orientation from said hopper to said first chute;

a second chute connected to said first chute and said button feeding mechanism for directing buttons from said first chute to said button feeding mechanism;

means controlling the transfer of a button from said first chute to said second chute and responsive to an electrical signal; and means connected to said sewing machine for producing said electrical signal in said controlling means when said sewing machine is in a predetermined operating position.

8. The button supplying system of claim 7, wherein said electrical signal is generated when said sewing machine is in a position for sewing a button onto an article.

9. The button supplying means of claim 7, wherein said controlling means comprises a solenoid responsive to said electrical signal and coupled to means to disengage a first button in said first chute for movement down said first chute and means to inhibit the movement of a second button in said first chute, whereby a single button is directed to said button feeding mechanism for a given electrical signal.

10. The button supplying system of claim 9, wherein said means for inhibiting the movement of the second button can be moved to a spatial position for accommodating buttons having a predetermined range of diameters.

11. The button supplying system of claim 7 further comprising a control switch for producing said electrical signal independently of said sewing machine.

12. A support for positioning a button feeding mechanism near a sewing machine for the smooth feeding of buttons from said button feeding mechanism into said sewing machines;

said support comprising;

mounting means comprising a base and means for connecting said base to a surface so that a portion of said base is moveable parallel to said surface or so that said base is fixed with respect to said surface;

a first component comprising a cylindrical portion connected to and extending vertically from the portion of said base which can be moveable;

a cylindrical collar engaging said cylindrical portion, and comprising means to fix its position axially and rotationally with respect to said cylindrical portion and a first extended portion for fixing the rotational position of said button feeding mechanism;

a second component having a cylindrical opening and engaging said cylindrical portion, said second component supported by said cylindrical collar and comprising means to fix its angular position with respect to said cylindrical portion and a second extension which engages said first extension to define the angular position of said second component by the angular position of said cylindrical collar;

a third component connected to said second component and comprising a cylinder mounted for both axial and rotational movements with respect to said third component and having its axis generally parallel to said surface, and means to fix the position of said cylinder both axially and rotationally with respect to said third component; and means for connecting said cylinder to said button feeding mechanism so that said button feeding mechanism is rotatable around an axis parallel to said surface or said button feeding mechanism can be fixed with respect to said surface.

13. A sewing machine system comprising a sewing machine;

a button feeding mechanism for feeding buttons to a clamp on a raised arch of said sewing machine comprising a frame, driving means mounted on said f rame, a first rod mounted on said frame for reciprocal movement and having an initial position, coupling means for coupling said driving means to said first rod selectively to move said first rod from its initial position to a cycle of movement, orienting means mounted on said frame for orientinq a button and coupled to said first rod, a second rod coupled to said first rod and mounted on said frame for reciprocal motion, moving means coupled to said second rod for moving a button through the orienting means to the clamp of said sewing machine, and an electrical circuit for energizing said coupling means by the simultaneous condition of the arch of said sewing machine being in its raised position subsequent to being in its lowered position and said first rod being in its initial position;

a button supplying system for supplying buttons to said button feeding mechanism comprising a hopper for holding a plurality of buttons; a first chute connected to said hopper for receiving buttons discharged from said hopper; means to discharge buttons having a predetermined orientation from said hopper to said first chute; a second chute connected to said first chute and said button feeding mechanism for directing buttons from said first chute to said button feeding mechanism; means controlling the transfer of a button from said first chute to said second chute and responsive to an electrical signal; and means connected to said sewing for producing said electrical signal into said controlling means when said sewing machine is in a predetermined operating position; and a support for positioning said button feeding mechanism near said sewing machine for the smooth feeding of buttons from said button feeding mechanism into said sewing machine; said support comprising mounting means including a base and means for connecting said base to a surface so that a portion of said base is moveable parallel to said surface or so that said base is fixed with respect to said surface; a first component comprising a cylindrical portion connected to an extending vertically front the portion of said base which can be moveable; a cylindrical collar engaging said cylindrical portion, and comprising means to fix its position axially and rotationally with respect to said cylindrical portion and a first extended portion for fixing the rotational position of said button feeding mechanism; a second component having a cylindrical opening and engaging said cylindrical portion, said second component supported by said cylindrical collar and comprising means to fix its angular position with respect to said cylindrical portion and a second extension which engages said first extension to define the angular position of said second component by the angular position of said cylindrical collar; a third component connected to said second component and comprising a cylinder mounted for both axial and rotational movements with respect to said third component and having its axis generally parallel to said surface, and means to fix the position of said cylinder both axially and rotationally with respect to said third component; and means for connecting said cylinder to said button feeding mechanism so that said button feeding mechanism is rotatable around an axis parallel to said surface or said button feeding mechanism can be fixed with respect to said surface.

14. The sewing machine system of claim 13 wherein said sewing machine comprises a solenoid operated hook movable vertically and a mechanical coupling between said hook and said arch for moving said arch between its raised and lowered position, wherein said mechanical coupling comprises a spring biased interconnection between said arch and said hook for minimizing the sudden movements of said hook.

* * * * *